US009095497B1

(12) United States Patent
Prince

(10) Patent No.: US 9,095,497 B1
(45) Date of Patent: Aug. 4, 2015

(54) MEDICATION LOADER FOR A MEDICATION ORGANIZER

(71) Applicant: Paul R. Prince, Temecula, CA (US)

(72) Inventor: Paul R. Prince, Temecula, CA (US)

( * ) Notice: Subject to any disclaimer, the term of this patent is extended or adjusted under 35 U.S.C. 154(b) by 0 days.

(21) Appl. No.: 14/167,978

(22) Filed: Jan. 29, 2014

Related U.S. Application Data

(63) Continuation-in-part of application No. 29/420,501, filed on May 9, 2012, now Pat. No. Des. 687,162.

(60) Provisional application No. 61/759,894, filed on Feb. 1, 2013.

(51) Int. Cl.
*B07C 7/04* (2006.01)
*A61J 7/02* (2006.01)
*A61J 1/03* (2006.01)

(52) U.S. Cl.
CPC ..... *A61J 1/03* (2013.01)

(58) Field of Classification Search
CPC ..... A61J 1/03; B65D 83/04; B07C 7/02
USPC ..... 206/539, 536, 531, 533, 540, 538; 414/675; 221/263, 93, 87, 45, 67–68; 209/1, 702, 614
See application file for complete search history.

(56) References Cited

U.S. PATENT DOCUMENTS

| | | | | |
|---|---|---|---|---|
| 2,507,792 | A * | 5/1950 | King | 414/675 |
| 2,530,009 | A * | 11/1950 | Fields | 222/129 |
| 2,812,076 | A * | 11/1957 | Mistretta | 414/675 |
| 3,255,895 | A | 6/1966 | Van Handel | |
| 4,063,645 | A * | 12/1977 | Canterman et al. | 209/702 |
| 4,121,722 | A * | 10/1978 | Sussman | 414/675 |
| 4,851,649 | A * | 7/1989 | McCanney | 235/98 R |
| 5,117,982 | A * | 6/1992 | Shotthafer et al. | 209/614 |
| 5,477,981 | A * | 12/1995 | Heyl et al. | 221/86 |
| 6,196,426 | B1 * | 3/2001 | White | 222/572 |
| 6,761,010 | B1 | 7/2004 | Gibson | |
| 6,779,663 | B1 | 8/2004 | Pocsi | |
| 7,334,699 | B2 | 2/2008 | Keffeler | |
| 2007/0062964 | A1 * | 3/2007 | Kampf et al. | 220/835 |
| 2010/0155411 | A1 | 6/2010 | Solari | |

* cited by examiner

*Primary Examiner* — Mickey Yu
*Assistant Examiner* — Chun Cheung
(74) *Attorney, Agent, or Firm* — QuickPatents; Kevin Prince

(57) ABSTRACT

A medication loader is disclosed for quickly loading medications into medication organizers such as seven-day pillboxes. Seven pills are quickly isolated and trapped as the excess pills are held separately and then blocked while the trapped pills are directed into the seven chambers of the organizer.

3 Claims, 10 Drawing Sheets

10
104
107
38
39
102A 10
104
106
38
39
102B 10
26A-26A
38
39
102A
7.25 inch example 10
26B-26B
102B
8.25 inch example

MEDICATION LOADER FOR A MEDICATION ORGANIZER

CROSS-REFERENCE TO RELATED APPLICATIONS

This application claims the benefit of U.S. Provisional Patent Application 61/759,894 filed on Feb. 1, 2013, and U.S. Design patent U.S. D687162, issued on Jul. 30, 2013, both incorporated herein by reference.

STATEMENT REGARDING FEDERALLY SPONSORED RESEARCH AND DEVELOPMENT

Not Applicable.

FIELD OF THE INVENTION

This invention relates to the field of medication organizers, and more particularly to a medication loader for filling compartments of medication organizers such as common 7-day pillboxes.

DISCUSSION OF RELATED ART

Currently many people in developed countries consume medications and drugs, vitamins, and nutritional supplements in the form of pills, capsules, tablets, etc. in significant quantities, all referred to herein as "pills". Medications, even for children, are taken in an attempt to lose weight, protect bones, increase muscle mass, control blood pressure, reduce inflammation, improve digestion, and improve blood chemistry to name just a few. People are generally short of time and in need of time saving devices and methods. Many people use 7-day AM/PM pillboxes and other varieties of medication organizers in order to avoid opening each of their many medication bottles every day. A 7-day pillbox is defined herein as a string of seven chambers for organizing medications for a week. A popular 7-day AM/PM pillbox is a container of two 7-day pillboxes joined back-to-back.

Prior art includes complex medication dispensers and pillboxes with dispensers, manual pill counting devices adapted to pill dispensing, and medication bag dispensers to aid in reducing contamination of medications. None of the prior art devices are truly low cost and time efficient such as a one-piece or two-piece molded device for quickly isolating and distributing a weeks' medications into 7-day pillboxes without the involvement of is manual sorting. For example U.S. Pat. No. 7,334,699 by Keffeler et. al. issued on Feb. 26, 2008 teaches a medication dispenser with a sliding slide with apertures pre-loaded with tablets, the slide alignable with individual compartments to dispense tablets into the compartments. The preloaded slides indicate more of a pharmacist or hospital use, and nothing is taught about capturing and isolating pills in a parallel fashion. Van Handel et. al. in U.S. Pat. No. 3,255,894 teaches a counting tray intended more for pharmacists' use. U.S. Pat. No. 6,761,010 by Gibson issued Jul. 13, 2004 teaches a medication organizing system for manually preparing sealed packages of medication for the elderly, but involving a complicated and costly assembly. U.S. Pat. No. 6,779,663 by Pocsi issued Aug. 24, 2004 termed a pill loader system is basically a 2-layer pillbox with 28 containers in each layer, with an insert card between layers. The user is required to deposit each pill into the top container manually wherein the pill drops to the lower container when the card is removed. This system is somewhat more complicated than a pillbox alone requiring manually inserting each pill into its chamber.

Therefore, there is a need for a device that quickly isolates a group of similar pills into 7 single isolated pills and delivers those pills reliably into a 7-day pillbox with minimal risk of contamination and error (missing or extra pills within a single chamber of the pillbox). It is particularly difficult and time consuming to hand deliver a single pill into a single chamber of a pill organizer and repeat for all 7 days and then repeat that for each of the several pills taken each day, particularly when the user/patient is elderly and may have arthritis or other disabling conditions. Caregivers will benefit from the time savings realized. So there is a serious need when considering the millions upon millions of pill is consumers looking to save time; there is a need for isolating 7 pills in parallel and delivering them into a pill organizer quickly. There is a need to provide good visibility such that mistakes are identified immediately and prior to dispensing of isolated pills into the organizer. The present invention accomplishes these objectives.

SUMMARY OF THE INVENTION

The present invention is a low cost medication loader for a medication organizer such as a 7-day AM/PM pillbox, or several pillboxes if more than one weeks' supply is to be loaded at one sitting. In a first preferred embodiment, a single molded part, the medication loader consists of a directing tray with a hinged flap in which the tray receives a substantial number of pills poured into its central area. A user holds the device and shakes laterally to distribute the pills generally into an isolation structure in the center of the tray and begins tilting the tray backward to allow pills to slide toward the back of the tray, some of the pills becoming trapped in pill traps while excess pills slide past and into an excess pill collection structure toward the back of the tray.

As the backward tilting action is performed, such as with the left hand, the tray is caused to shake slightly either by tapping with a finger or by employing an integral electromechanical shaker in one embodiment. Once the required number of pills have been trapped, for example seven, and all excess pills have moved into an excess pill collection structure, the backward tilting and shaking stimuli are terminated and the hinged flap, previously opened, is closed over the excess pills at the back of the tray in order to contain the excess pills. The device is then situated over the pill organizer, such as a 7-day pillbox with lids open, and the directing tray is tilted forward, stabilizing it in place with notches in the tray to align with walls in the pillbox. At that point the directing tray is tilted forward to allow trapped pills to slide into the individual pillbox chambers. This quick process is then repeated for a $2^{nd}$ weeks' pills into a second pillbox if desired, then a $3^{th}$, etc. When all of the pillboxes are charged with the present medication, remaining excess pills are poured back into the pill bottle using a spout structure of the directing tray. This process is then repeated for the next medication to be dispensed into the pillboxes. Initially the pillbox lids that are latched closed can be opened simultaneously using a lid opener situated on the back of the medication loader of the present invention. In a preferred embodiment the device allows for use with various sized 7-day pillboxes by adapting to a range of pillbox widths.

Other features and advantages of the present invention will become apparent from the following more detailed description, taken in conjunction with the accompanying drawings, which illustrate, by way of example, the principles of the invention.

DESCRIPTION OF THE DRAWINGS

FIGS. 11-1 through 11-6 are cross sectional diagrams following FIG. 7 illustrating six exemplary pill sizes and shapes wherein the device is rotated to six final backward angles $\alpha_1$ through $\alpha_6$;

DETAILED DESCRIPTION OF THE PREFERRED EMBODIMENTS

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 4:
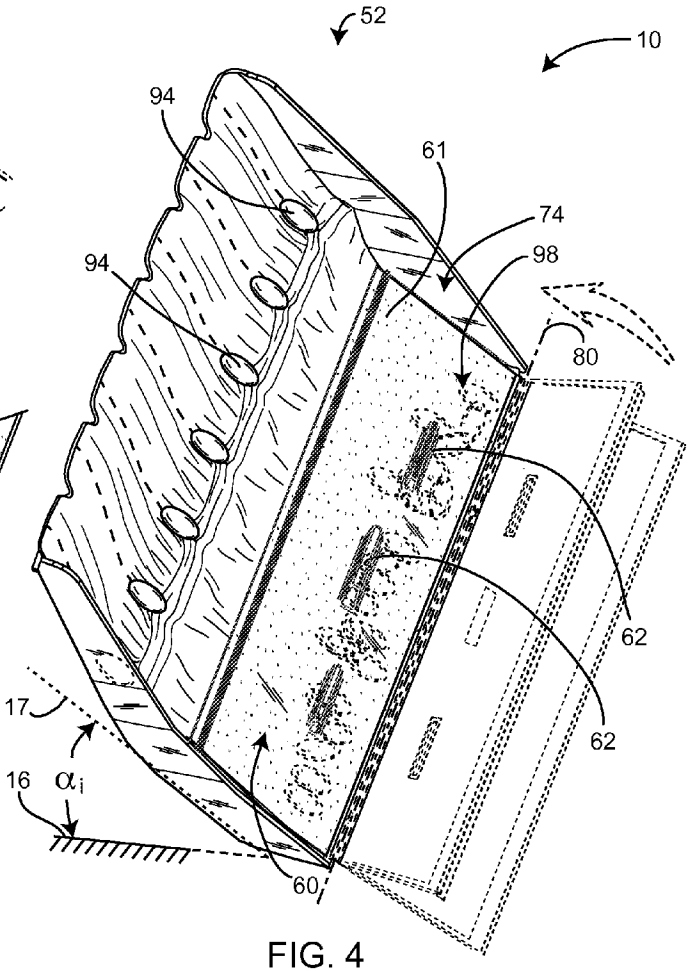
FIG. 4 is a top perspective view of the device in the backward tilting orientation at a final angle $\alpha_t$ with seven pills isolated and captured, further illustrating the flap rotated to a closed flap position, enclosing excess pills.
Figure 5:
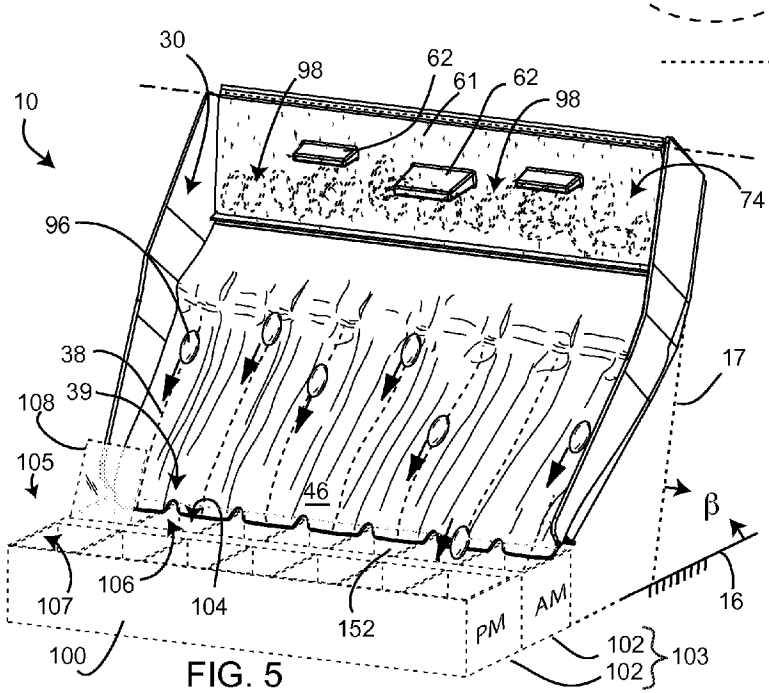
FIG. 5 is a frontal perspective view of the medication loader in a forward tilting orientation wherein the medication loader is rotated so that the base plane reaches a forward angle $\beta$ with respect to horizontal, delivering captured pills into the medication organizer shown as a 7-day AM/PM pillbox with seven AM chambers and seven PM chambers.

With respect to the drawings, FIGS. 1, 3, 4, 5, 10, 12, 14, 15, 16, 18, 19, 25A and 25B illustrate various embodiments and orientations of medication loader 10 for isolating and trapping seven pills 90 and dispensing seven released pills 96 with a directing tray 30 into a medication organizer 100 illustrated as a commonly used 7-day AM/PM pillbox 103 (FIG. 5), wherein each of the seven released pills 96 enter into one of the chambers 104, and the 7-day AM/PM pillbox 103 consists of two 7-day pillboxes 102 joined back-to-back. Pillbox walls 105 include six inner walls 106 along with the outside walls 107 (FIG. 5).

Figures 1, 2:
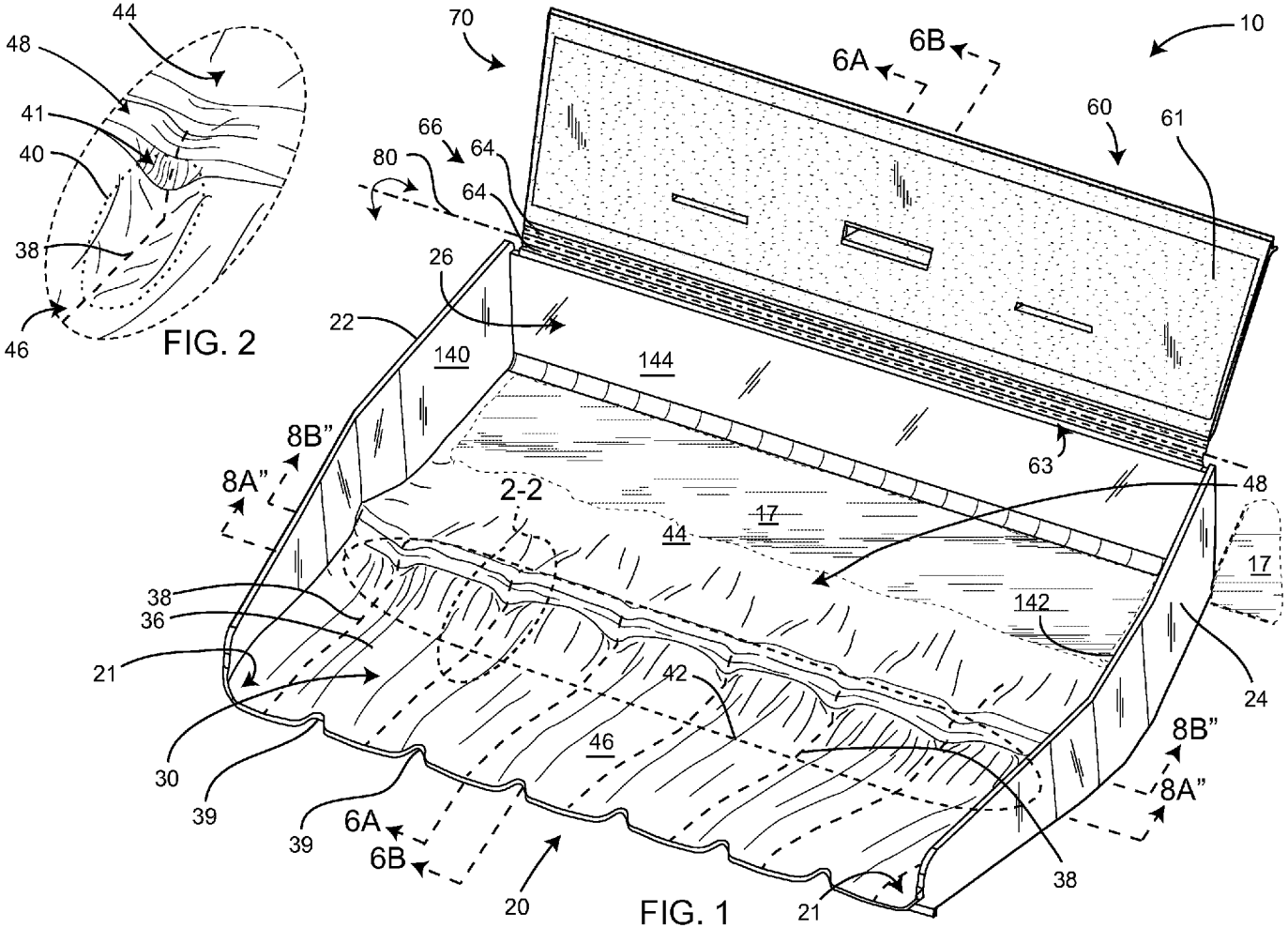
FIG. 1 is a front perspective view of a first preferred embodiment medication loader for loading medications into a 7-day medication organizer illustrating a contoured platform with three walls and a hinged flap.
FIG. 2 is an expanded view of a pill trap on the top surface of the contoured platform taken generally along lines 2-2 of FIG. 1.
Figure 12:
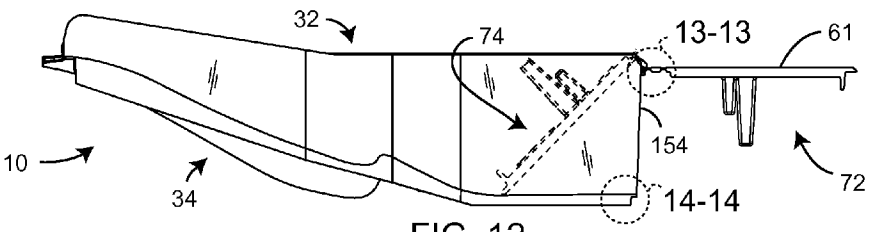
FIG. 12 is a left side elevation view of the medication loader illustrated in a mold orientation as it might be positioned in an injection-molding machine.
Figure 13:
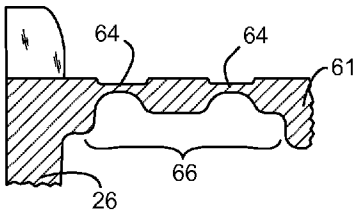
FIG. 13 is an expanded elevation cross sectional view taken generally along lines 13-13 of FIG. 12, further illustrating a dual living hinge.
Figure 15:
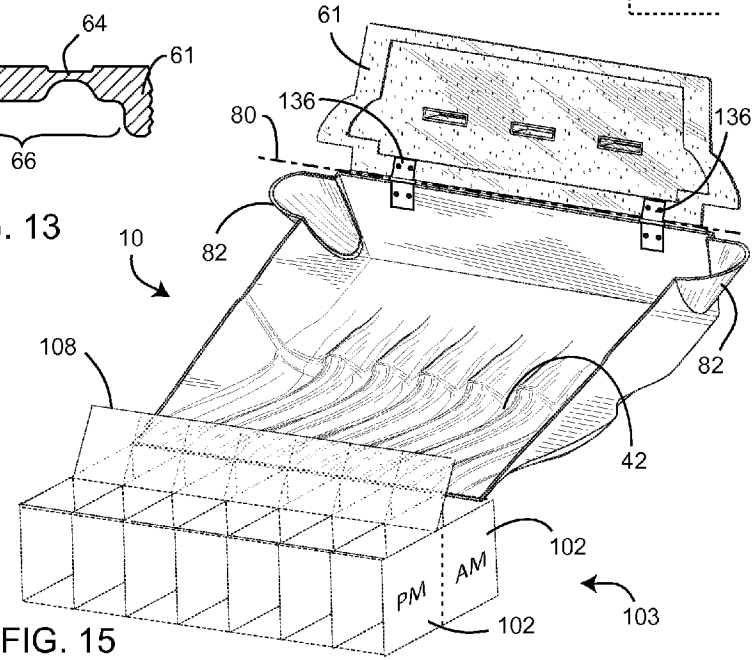
FIG. 15 is a perspective view of an alternate embodiment of the medication loader with rearward spouts and mechanical hinges.

In a first preferred embodiment of FIG. 1, a hinged flap 61 may be rotated about a hinge axis 80 and is illustrated in an open flap position 70. Two living hinges 64 comprising a dual living hinge 66 is connected between the top edge of the back wall 63 and the hinged flap 61 to allow the flap to rotate in excess of 125° about the hinge axis 80 to a closed flap position 74 (FIG. 4) wherein the hinged flap 61 becomes a blocker 60 for excess pills 98 that are blocked, thereby isolating the seven trapped pills 94. The directing tray 30 comprises a contoured platform 48, a right side 22, a right wall 140, a left side 24, a left wall 142, a back side 26, a back wall 144, an open front 20, and as shown in FIG. 12, an open top 32, and a bottom 34. The contoured platform 48 comprises a top surface 36, a pill isolation structure 42, seven pill traps 40 (FIG. 2) that each include a pill stop 41, an excess pill collection structure 44, and a delivery slide 46 with seven pill tracks 38. A substantially flat region toward the back of the excess pill collection structure 44 defines a bottom plane 17 for describing angles of tilt of the medication loader 10 with respect to a horizontal plane 16 (FIGS. 1 and 3-5).

Figure 3:
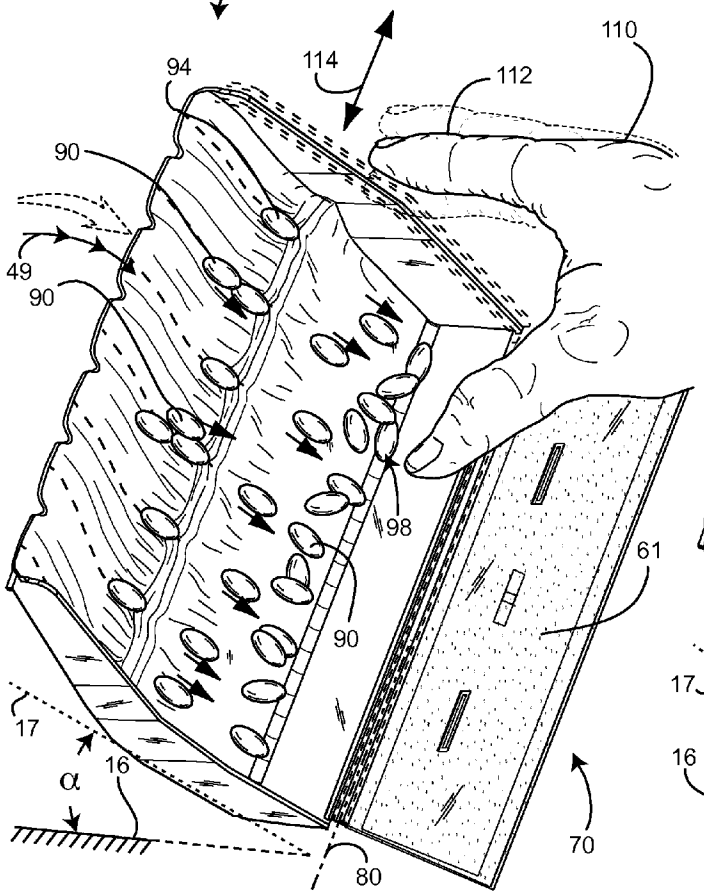
FIG. 3 is top perspective view of the medication loader in a backward tilting orientation wherein the medication loader is rotated so that a bottom plane of the medication loader reaches a backward angle $\alpha$ with respect to a horizontal plane with pills being isolated and captured into the pill traps while excess pills slide to an excess pill collection structure behind, with the hinged flap in an opened flap position.
Figure 20:
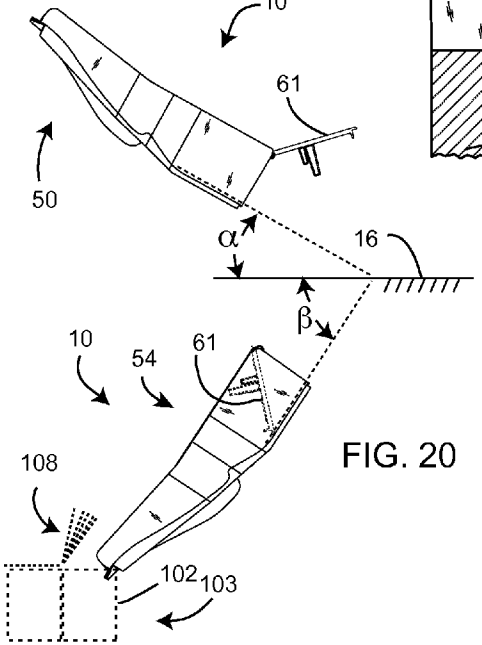
FIG. 20 is a side elevation diagram illustrating the backward tilting orientation and the forward tilting orientation and the associated angles.

The process for isolating seven pills 90 is initiated by pouring a sufficient number of pills 90 into the directing tray 30 such that there are excess pills 98 exceeding the desired seven pills to be captured (FIG. 3). While holding the medication loader 10 in one or two hands 110 (FIG. 3), a user begins tapping the device with a finger 112 to create a shaking motion 114 as the device is gradually tilted in a backward motion 49 establishing a backward tilting orientation 50 and finally a backward trapping orientation 52. As pills 90 become trapped, excess pills 98 move aside or over trapped pills 94. The angle of tilt is measurable as angle $\alpha$ of bottom plane 17 with respect to horizontal plane 16 while the hinge axis 80 is held substantially horizontal until seven pills 90 are isolated and trapped within the seven pill traps 40 as seven trapped pills 94 at a final backward angle $\alpha_i$ (FIG. 4). Thereafter the hinged flap 61 is rotated into a closed flap position 74 (FIGS. 4, 20, 25A and 25B) facilitated by flap handles 62 to block the excess pills 98 from entering back into the directing tray 30. Once the hinged flap 61 is closed, the medication loader 10 is rotated in a forward tilting orientation 54 measurable as angle $\beta$ (FIGS. 5 and 20) and aligned with the 7-day pillbox 102 with the pillbox substantially level and the hinge axis substantially level, for directing released pills 96 into the seven chambers 104 of the 7-day pillbox 102. This process is aided by the use of six alignment notches 39 in the medication loader by guiding the alignment notches 39 over the six inner pillbox walls 106. A user can then deliver one pill type into one or several 7-day pillboxes and thereafter pour the remaining excess pills 98 into the original pill bottle 130 using a spout 82 situated in a front corner 21 of the first preferred embodiment medication loader 10 (FIG. 10) wherein the device is situated in a forward tilting and angled orientation 56, or a spout 82 elsewhere on an alternate configuration medication loader 10 (FIG. 15) which is illustrated with separate mechanical hinges 136 in place of the dual living hinge 66. Angles $\alpha$ and $\beta$ are further illustrated in the cross-sectional diagram of FIG. 20.

Figure 16:
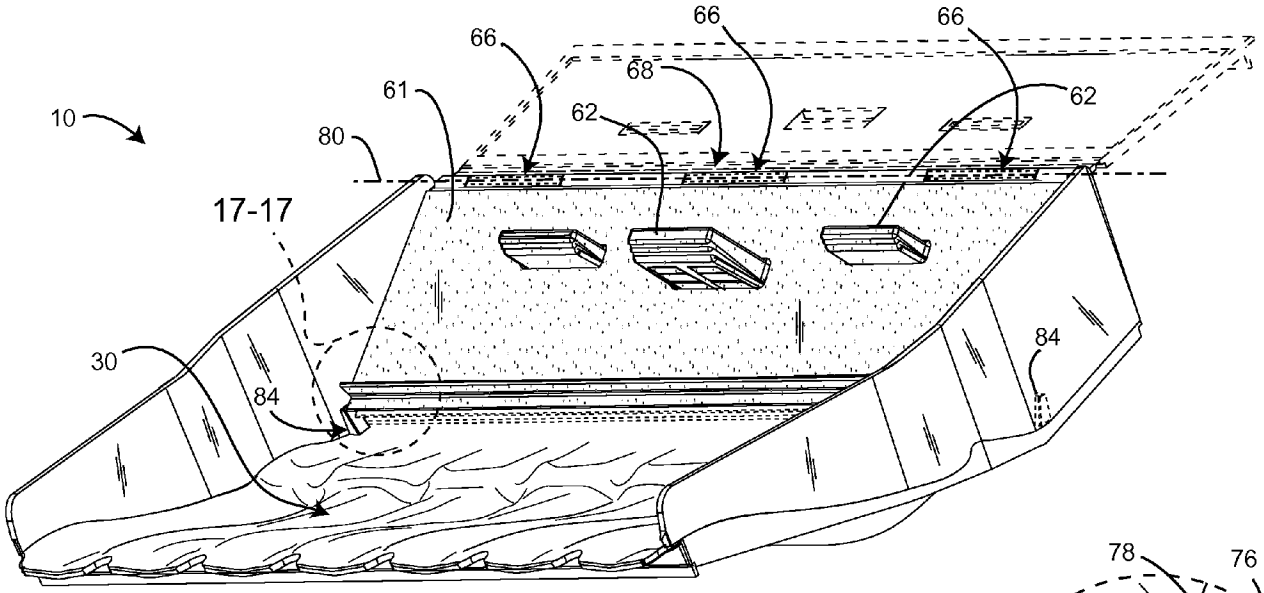
FIG. 16 is a frontal perspective view of the medication loader with a flap latch for capturing the hinged flap and securing in the closed position, further illustrating an optional discontinuous dual living hinge for reducing hinge torque.
Figure 17:
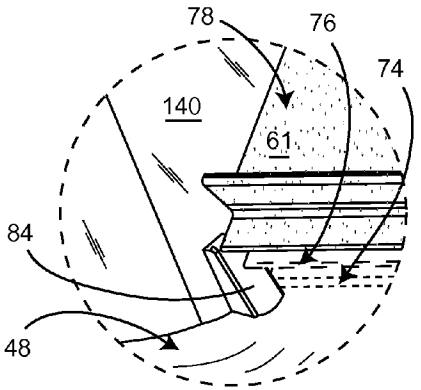
FIG. 17 is an enlarged view of the flap latch for holding the flap in the closed position taken generally along lines 17-17 of FIG. 16.

FIG. 16 illustrates an alternate hinge arrangement medication loader 10 utilizing a discontinuous dual living hinge 68. Other hinge arrangements are available and known in the art, such as a single or discontinuous living hinge, axle-bushing hinges 168 (FIGS. 21-25B), all within the scope of the present invention. An optional flap latch 84 (FIGS. 16 and 17) allows for a more distinct closed flap position 74 by slightly distorting flap 61 as it is forced against flap latches 84 on both sides. The sequence (FIG. 17) for latching the flap follows a latch contact flap position 78, a latching flap position 76 as the components distort slightly, and finally the closed flap position 74 when the flap becomes temporarily locked behind flap latch 84.

It is anticipated that medication loader 10 will be injection molded with a plastic such as polypropylene for living hinge configurations with an expected mold orientation 58 and mold flap position 72 as illustrated in FIG. 12. As is typical in the art, mold adjustments, or mold 'tuning' will be provided. Flap latch 84 will be 'tuned' in the mold manufacture to provide proper latching and un-latching (using flap handles 62) with ease as well as mold tuning for proper flap hinge operation. Alternative medication loaders 10 not incorporating living hinges will have available a broad selection of plastics known in the art for manufacture.

Figure 18:
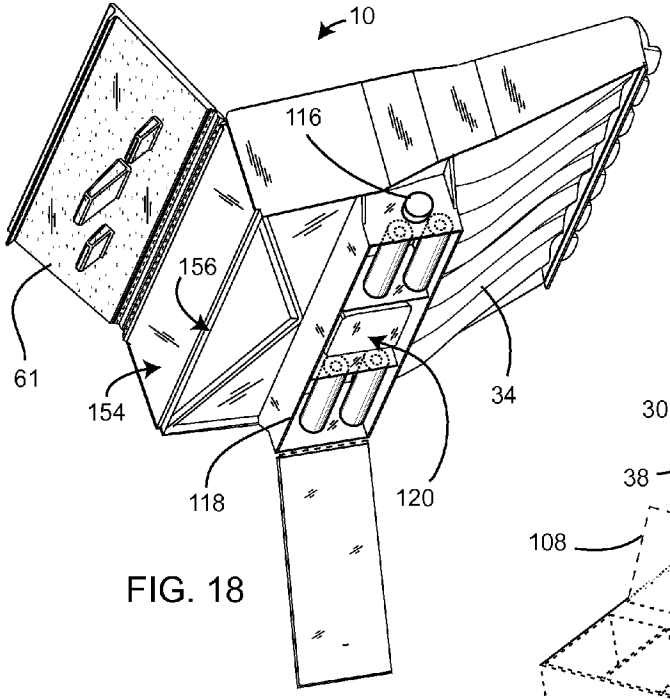
FIG. 18 is an underside perspective view of an automatic medication loader including an electromechanical shaker mounted thereunder.

FIG. 18 illustrates another alternate configuration medication loader 10 wherein an electromechanical shaker 120 is connected with the underside of the directing tray 30 to aid in the necessary shaking Electromechanical shaker 120 is held within a shaker housing 118 and may be provided with a shaking adjuster 116 which may include a potentiometer well known in the art to adjust the frequency of the shaking motion 114. The electromechanical shaker 120 may be energized with an enclosed battery, with an AC adapter, or other means, all well known in the art.

Figure 19:
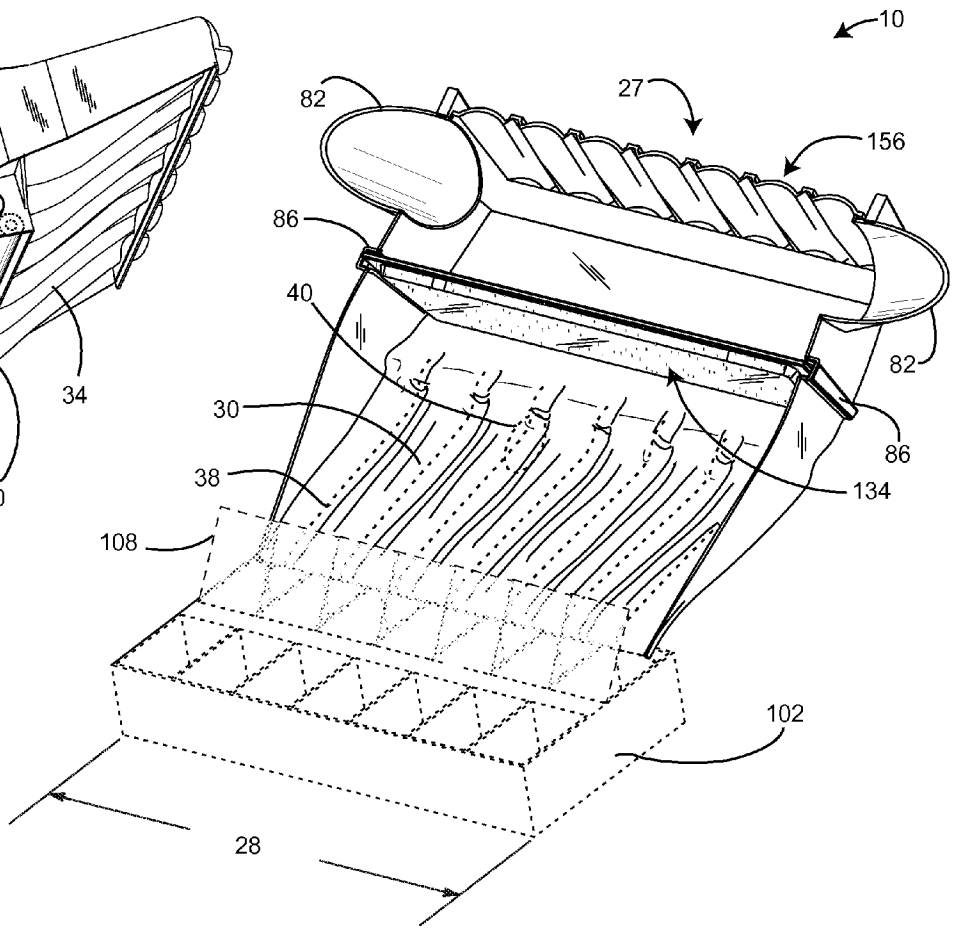
FIG. 19 is a frontal perspective view of an alternate embodiment medication loader including a blocker panel for containing excess pills, including spouts situated in the back.

FIG. 19 illustrates yet another alternate configuration medication loader 10 wherein the hinged flap 61 is replaced with a blocking panel 134 that may be slid into blocker slots 86 for blocking excess pills 98.

Figure 22:
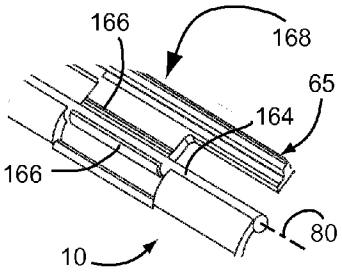
FIG. 22 is an expanded view of an axle-bushing hinge taken generally along lines 22-22 of FIG. 21.
Figure 21:
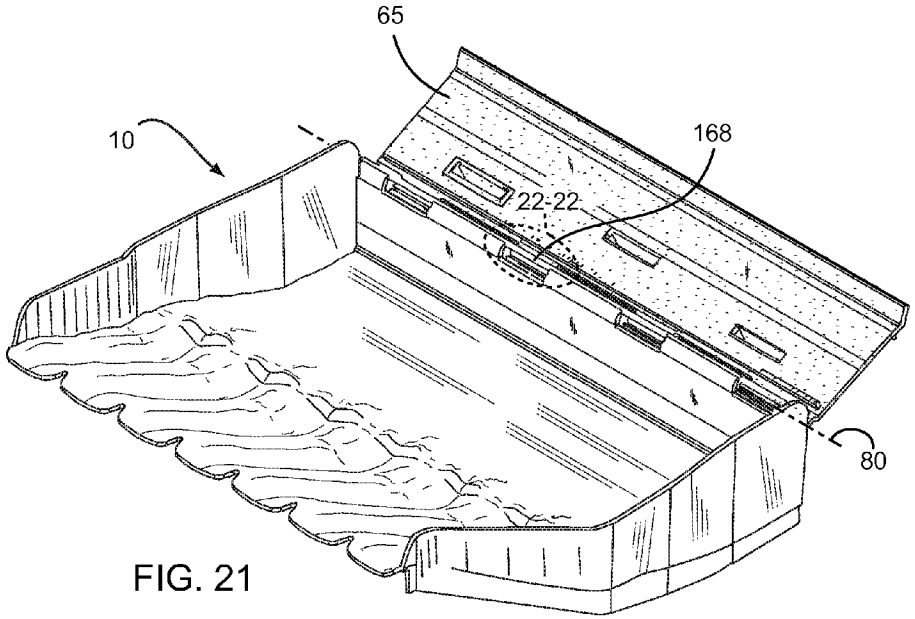
FIG. 21 is a front perspective view of a second preferred embodiment medication loader assembly featuring alternate molded hinges including 4 axles on the directing tray and 4 bushings on the separately molded flap.
Figure 23:
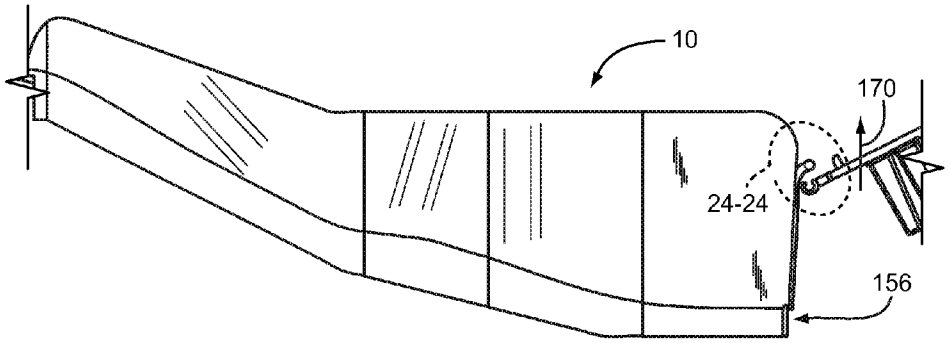
FIG. 23 is an exploded left side elevation view of the second preferred embodiment medication loader assembly illustrating a separate flap aligned ready for assembly to the directing tray.
Figure 24:
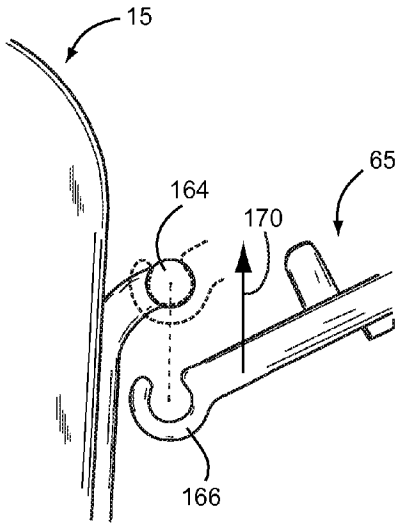
FIG. 24 is an expanded elevation cross-sectional view of the delivery tray and separate flap taken generally along lines 24-24 of FIG. 23.

A two-piece molded second preferred embodiment medication loader 10 is an assembly as illustrated in FIG. 21 wherein the top edge of the back wall 63 of the device includes a is number of hinge axles 164, and a separate flap 65 includes a like number of hinge bushings 166. When the hinge bushings 166 are snapped onto the hinge axles 164, the device becomes a single assembly, the separate flap 65 attached to the back wherein the hinge axles 164 and the hinge bushings 166 form axle-bushing hinges 168 (FIG. 22). This medication loader assembly is illustrated in FIGS. 21 through 25B. Hinge bushing 166 distorts slightly as it is snapped in place (FIG. 24).

Figures 25A, 25B, 26A, 26B:
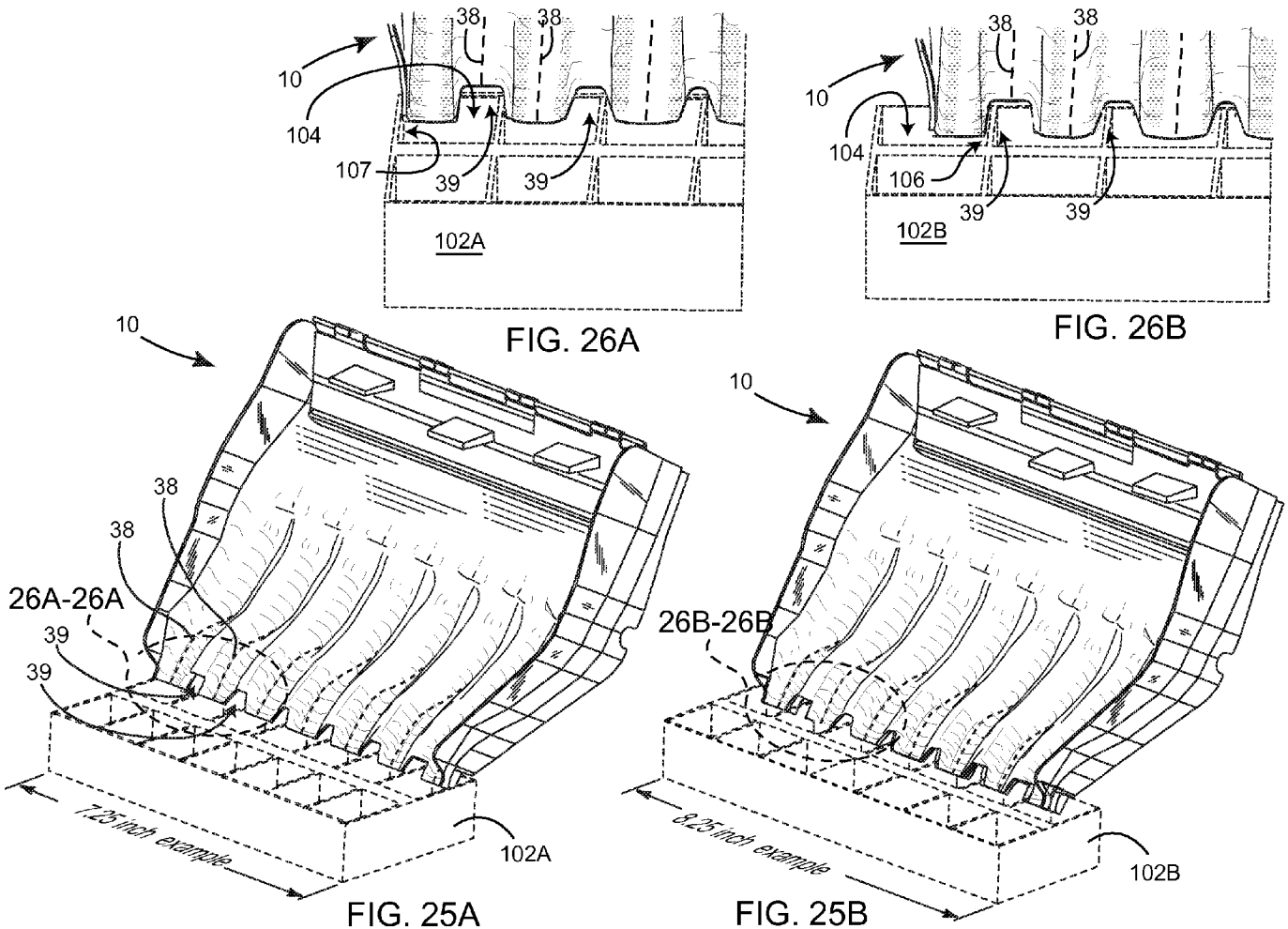
FIG. 25A is a perspective view of a third preferred embodiment medication loader illustrating use with a common 7.25 inch wide 7-day pillbox.
FIG. 25B is a perspective view of the third preferred embodiment medication loader illustrating use with a common 8.25 inch wide 7-day pillbox.
FIG. 26A is an enlarged frontal perspective view of the third preferred embodiment medication loader taken generally along lines 26A-26A of FIG. 25A.
FIG. 26B is an enlarged frontal perspective view of the third preferred embodiment medication loader taken generally along lines 26B-26B of FIG. 25B.

Typically, a user of pillboxes closes and latches the pillbox lids 108 (FIG. 5) after using the pills from a chamber 104, and there may be 7 AM and 7 PM chambers in a 7-day AM/PM pillbox 103. Other pillboxes may have four chambers, for example, for each day and are usable with the present invention. Yet other pillboxes may be wider or narrower than the common 7-day AM/PM pillbox 103 of width approximately 7.25 inches (FIG. 25A). Other medication loader embodiments, not shown, may have attachments to adapt to various width pillboxes or expanding pill tracks 38 allowing a user to cut off the front end at the desired width for that users' preferred pillbox. A third preferred embodiment medication loader is illustrated in FIGS. 25A and 25B wherein pill tracks 38 and alignment notches 39 are shaped to allow use with a range of 7-day pillbox 102 widths such as 7.25 inch wide pillbox 102A and 8.25 inch pillbox 102B. It is seen in FIGS. 26A and 26B that the medication loader aligns with the outer most chamber toward an outer wall 107 for the smaller 7.25 inch wide pillbox 102A and an inner wall 106 for the larger 8.25 inch wide pillbox 102B, the enlarged alignment notches 39 enabling the use of the present invention with pillboxes exhibiting a range of pillbox widths 28.

Figure 14:
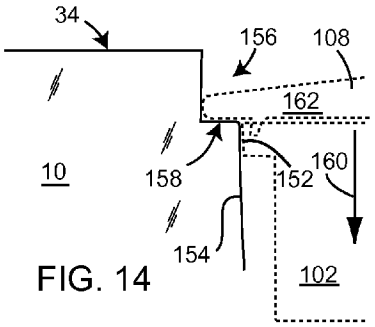
FIG. 14 is an expanded view taken generally along lines 14-14 of FIG. 12 illustrating a lid opener of the invention for rapidly opening the latched lids of the 7-day pillboxes, the medication loader illustrated in an inverted position.

FIG. 14 illustrates an optional feature for quickly opening the seven pillbox lids 108 at the beginning of a pillbox filling session. An inverted medication loader 10 of the invention is shown adjacent a 7-day AM/PM pillbox 103 illustrated in phantom with its latched lid 162 resting upon a rear ledge extension 158 of the medication loader bottom 34 while the pillbox front 152 rests against the medication loader back surface 154. A lid opener 156 in conjunction with the rear ledge extension 158 allows that with a lid release motion 160, all seven lids are quickly opened. These timesaving features of the invention allow a quicker pillbox filling session for individuals, and provide significant time savings for care givers.

Figure 6:
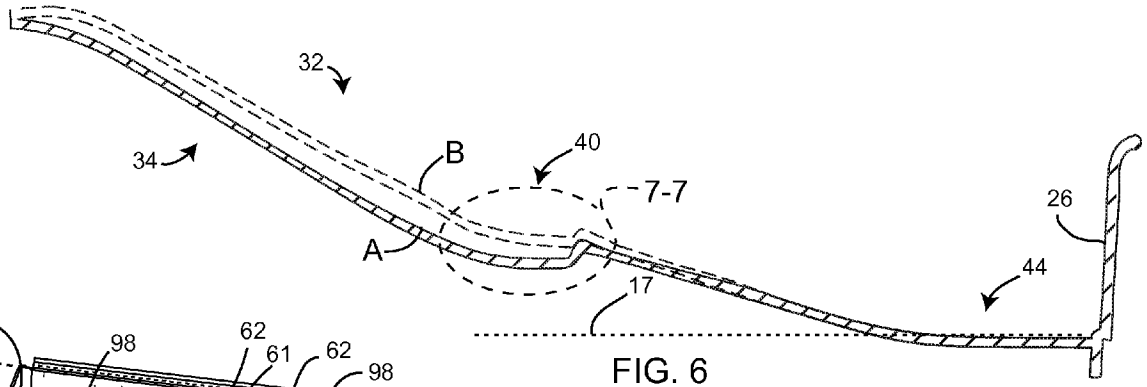
FIG. 6 is a cross sectional view of the medication loader taken generally along lines 6A, and 6B respectively of FIG. 1 illustrating two cross sectional slices through one of the pill traps at a lowest and a highest portion respectfully of the pill trap.
Figure 7:
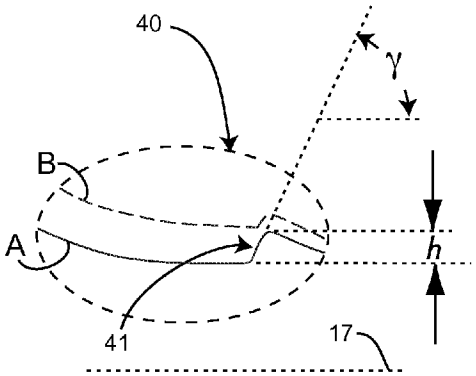
FIG. 7 is an enlarged partial view of FIG. 6 illustrating the sectional slices as A and B is respectively where the slices intersect the top surface, taken generally along lines 7-7 of FIG. 6.
Figure 8:
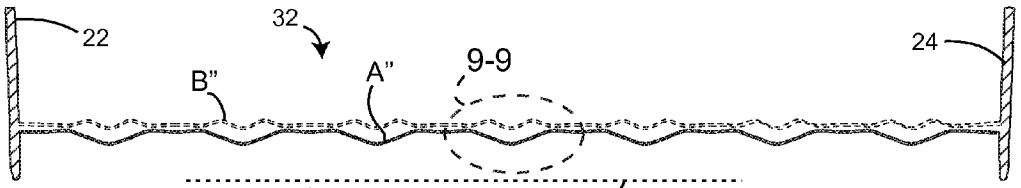
FIG. 8 is a cross sectional view of the device taken generally along lines 8A" and 8B" respectively of FIG. 1 illustrating two cross sectional slices through the seven pill traps at a low and a high portion of the pill trap.
Figure 9:
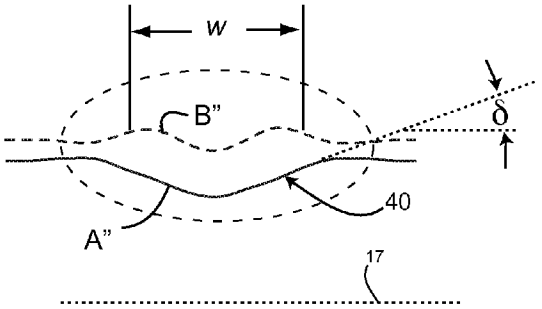
FIG. 9 is an enlarged partial view of FIG. 8 illustrating the sectional slices as A" and B" respectively where the slices intersect the top surface, taken generally along lines 9-9 of FIG. 8.
Figure 10:
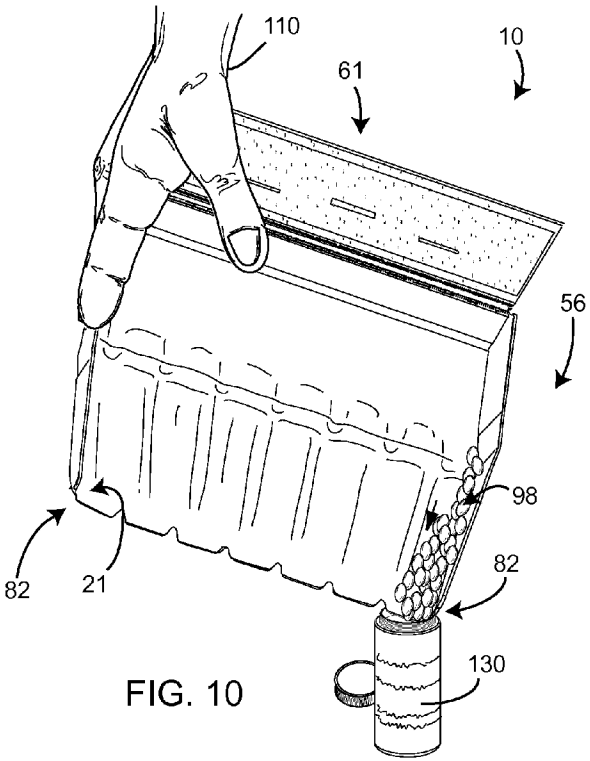
FIG. 10 is frontal perspective view of the medication loader in a forward tilting and angled orientation delivering excess pills to a pill bottle, the excess pills sliding along a left wall and the top surface forming a spout at a front corner of the directing tray.

FIG. 6 illustrates a side view of a pill trap 40 by superposing two cross-sectional slices through the pill trap at locations illustrated in FIG. 1 wherein slice A is taken through a lowest and slice B is taken through a highest portion of a pill trap 40 to clarify the trapping structure where a pill settles, centered generally in the pill trap 40 region of slice A. FIG. 7 further illustrates geometric properties of pill stop height h and pill stop back angle $\gamma$ both with respect to slice A, the lowest region of the pill trap 40. For clarity, only the top surface of slices A and B are illustrated in FIG. 7. Prototype devices have indicated that the pill stop back angle $\gamma$ is optimum at about 65° and useable over a range of about 65 °∓6.0° and pill stop height h is optimum at about 3.3 mm (0.13 inch)∓0.51 mm (0.02 inch). It is important to provide a three-dimensional shape that not only traps a single pill, but also encourages excess pills 98 to slide to the side or slide over a trapped pill 94. FIG. 8 illustrates two cross-sectional slices A" and B" taken normal to those of FIG. 6 as shown in FIG. 1, and exposes the pill trap geometry in that direction. Slice A" through the lowest point of the pill trap illustrates a pill trap side angle $\delta$ which may be 29°∓15° and a pill trap width w may be 15.3 mm∓5.1 mm (0.60 inch∓0.20 inch). It should be noted that the geometry of pill trap 40 may be changed generally within these ranges and the ease of trapping of pills therein will vary, but the nominal values above and the approximate shape of the slices shown in FIGS. 7 and 9 will provide for good trapping of pills. The minimum point in slice A of section 6A coincides substantially with the minimum point in slice A" of section 8A. Slice B" is taken approximately 12.0 mm (0.472 in.) behind slice A", behind meaning toward the back of the device. Slice B is taken approximately 11 mm (0.43 in.) to the side of slice A.

Figures 1, 11:
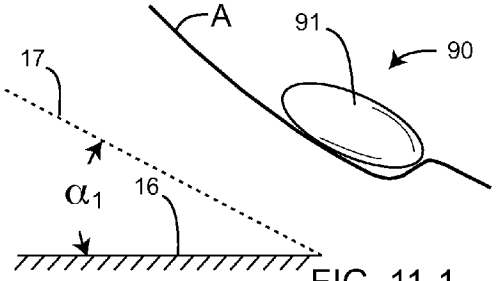
Figures 2, 11:
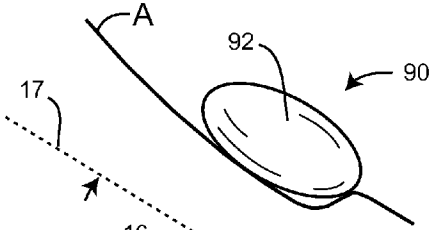
Figures 3, 11:
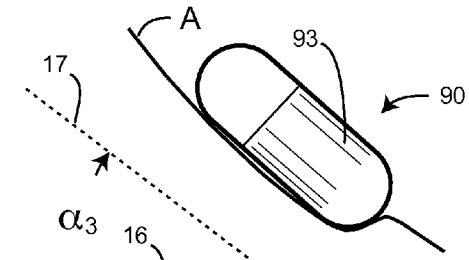
Figures 4, 11:
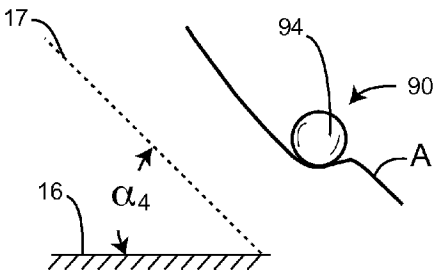
Figures 5, 11:
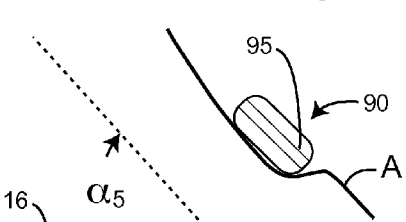
Figures 6, 11:
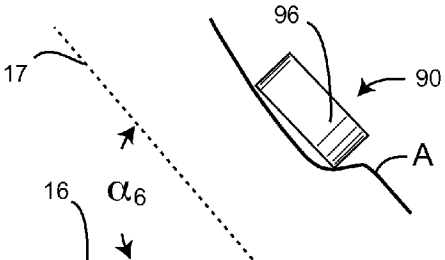

It is clear that pill 90 sizes, shapes, weights, and surface textures will vary substantially between the vast range of various medications, vitamins, supplements, and nutrients that are to be separated, isolated, trapped, and delivered to pillboxes with the present invention. FIGS. 11-1 through 11-6 are illustrated to clarify a variety of pill 90 shapes and sizes labeled 91 through 96 and the drawings are related to FIG. 6 slice A wherein the device is rotated backward to the backward trapping orientation 52 that is generally unique for each pill 91 through 96, and a final backward angle $\alpha_i$ shown as $\alpha_1$ through $\alpha_6$ is generally unique for any specific pill 91 through 96.

While a particular form of the invention has been illustrated and described, it will be apparent that various modifications can be made without departing from the spirit and scope of the invention for example with respect to the flap hinge design. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the is invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A method of loading pills into a medication organizer comprising the following steps:

providing a medication organizer with open lids and a medication loader comprising a directing tray having an elevationally-contoured platform, a right side, a right wall, a left side, a left wall, a back side, a back wall, a front, an open top, and a bottom; the elevationally-contoured platform including a top surface, a pill isolation structure, and an excess pill collection structure including a plurality of delivery slides each having a pill track leading inwardly to a pill trap terminating in a pill stop, the pill trap defined by elevational variation along the pill track and elevational variation normal to the pill track; and a blocker for retaining excess pills within the excess pill collection structure;

introducing a plurality of pills into the pill isolation structure of the pill directing tray;

shaking said directing tray while gradually increasingly rotating the directing tray in a backward direction;

allowing a pill to become trapped in each of said pill traps while excess pills move aside or over the trapped pills;

terminating the backward rotating of the directing tray when each pill trap is occupied with a single pill and all excess pills are in the excess pill collection structure;

blocking the excess pills with the blocker to retain the excess pills therebehind; and rotating the directing tray in a forward direction over the medication organizer and dislodging each trapped pill to slide along each delivery slide into a corresponding compartment of the medication organizer.

2. The method of claim 1 preceded by the steps of:

placing a pillbox with latched lids to rest on a rear ledge extension of an inverted said medication loader while the pillbox front rests against a medication loader back surface; and opening said latched lids with a lid release motion.

3. The method as recited in claim 1 including the steps of:

orienting the medication loader into a forward tilting and angled orientation over an original pill bottle; and pouring the excess pills into the original pill bottle.

* * * * *